US006061965A

United States Patent [19]

Schrock

[11] Patent Number: 6,061,965

[45] Date of Patent: May 16, 2000

[54] DOOR OPERATOR WITH SHORT STROKE ACTUATOR

[76] Inventor: Stanton E. Schrock, 1284 Stateline Rd., Waynesboro, Pa. 17268

[21] Appl. No.: 09/130,648

[22] Filed: Aug. 7, 1998

[51] Int. Cl.[7] ..... E05F 11/00

[52] U.S. Cl. ..... 49/360

[58] Field of Search ..... 49/360, 404; 160/84.09, 160/89.11

[56] References Cited

U.S. PATENT DOCUMENTS

| | | | |
|---|---|---|---|
| 350,750 | 10/1886 | Klecknetz et al. | 49/360 |
| 2,402,296 | 6/1946 | Rosenberg . | |
| 2,937,669 | 5/1960 | Ducharme . | |
| 3,345,728 | 10/1967 | Upchurch . | |
| 3,439,453 | 4/1969 | Avril . | |
| 3,464,161 | 9/1969 | Jonsson . | |
| 4,075,952 | 2/1978 | Burge . | |
| 4,417,418 | 11/1983 | Warning . | |
| 4,577,577 | 3/1986 | Eriksson | 49/360 X |
| 4,601,224 | 7/1986 | Fischer . | |
| 4,669,521 | 6/1987 | Barnes et al. . | |
| 4,766,820 | 8/1988 | Ritter et al. . | |
| 4,829,908 | 5/1989 | Hallam . | |
| 4,891,908 | 1/1990 | Aquilina . | |
| 5,235,723 | 8/1993 | Wallis | 49/404 X |
| 5,239,776 | 8/1993 | Lhotak . | |
| 5,384,975 | 1/1995 | Yuran . | |

FOREIGN PATENT DOCUMENTS

| | | | |
|---|---|---|---|
| 1344381 | 8/1955 | France | 160/84.3 |
| 15015 | 8/1903 | Germany | 49/404 |

*Primary Examiner*—Jerry Redman
*Attorney, Agent, or Firm*—Alvin R. Wirthlin

[57] ABSTRACT

A door operator system for slidable doors comprises an expandable and retractable lattice assembly adapted for connection between a door and a stationary structure. The lattice assembly includes forward and rearward link arms connected together at a pivot joint to form a link arm pair. Several link arm pairs may be pivotally joined together to form the expandable and retractable lattice assembly, such that the distance between a retracted position and an expanded position of the lattice assembly is relatively long. An actuator with a relatively short stroke length has a housing and a shaft that reciprocates with respect to the housing between retracted and extended positions. The housing is connected to a pivot joint of one pair of link arms and the reciprocal shaft is connected to a juxtaposed pivot joint of another pair of link arms. With this arrangement, movement of the shaft over the relatively short stroke length causes the lattice assembly to move between the retracted and expanded positions over the relatively long distance, thereby causing movement of the door with respect to the stationary structure over the relatively long distance. Pneumatic control circuitry for controlling operation of the door and safety features are disclosed.

24 Claims, 5 Drawing Sheets

DOOR OPERATOR WITH SHORT STROKE ACTUATOR

BACKGROUND OF THE INVENTION

1. Field of the Invention

This invention relates to mechanisms for opening and closing doors, and more particularly, to a door operator system which uses an actuator with a relatively short stroke length to move the door over a distance that is longer than the actuator stroke length.

2. Description of the Related Art

Many door operator systems over the years have been developed to assist persons in opening and closing doors from a remote location. Such systems typically include an electric motor mounted to a wall or ceiling of a garage or other structure. A sprocket is mounted to the motor shaft, or the shaft of a gear reduction assembly associated with the motor. A continuous chain is looped over the sprocket and one or more links of the chain are typically connected to the door through an arm member. Rotational movement of the motor thus causes opening or closing movement of the door.

Instead of the sprocket and chain assembly, the electric motor may be associated with a power screw assembly for opening and closing doors. U.S. Pat. No. 4,075,952 issued to Burge on Feb. 28, 1978 discloses a scissor-type slide gate opener for railroad cars. The opener has a cylindrical shaft with right and left-handed threads. Links are mounted to the shaft at pivot points and move axially along the shaft during rotation of the shaft. First arms are pivotally mounted to a stationary frame member and include gears that intermesh, and a pair of sockets that engage a pair of blocks. Second arms are pivotally connected between the first arms and a gate. Rotational movement of the shaft causes rotation of the first arms, which in turn causes sliding movement of the gate.

Other door operator systems include pneumatic assemblies, such as U.S. Pat. No. 4,891,908 issued to Aquilina on Jan. 9, 1990; or a combination of pneumatic and chain assemblies, as disclosed in U.S. Pat. No. 4,417,418 issued to Warning on Nov. 29, 1993.

The length of chains, power screws, air cylinders, etc. of prior art door operators are typically equal to or greater the distance needed to move the door between open and closed positions. Consequently, such operators can be unwieldy, difficult to install, and high in cost.

SUMMARY OF THE INVENTION

These and other problems of the prior art are overcome by the provision of a door operating system which, among other things, is low in cost, has relatively few parts to be installed, and is relatively easy to manipulate and install.

According to the invention, a door operator system comprises an expandable and retractable lattice assembly adapted for connection between a door and a stationary structure. The lattice assembly has a first pair of link arms pivotally connected together and at least a second pair of link arms pivotally connected together. The first pair of link arms is pivotally connected to the second pair of link arms, such that the distance between a retracted position and an expanded position of the lattice assembly is relatively long. An actuator has a first portion that is movable with respect to a second portion between a first position and a second position. The distance between the first and second positions is relatively short, i.e. shorter than the distance between the retracted and expanded positions of the lattice assembly. At least one of the first and second portions is operably connected to the lattice assembly for expanding and contracting the lattice assembly. With this arrangement, movement of the first portion of the actuator between the first and second positions over the relatively short distance causes the lattice assembly to move between the retracted and expanded positions over the relatively long distance, thereby causing movement of the door with respect to the stationary structure over the relatively long distance when the lattice assembly is connected between the door and the stationary structure.

Preferably, each pair of link arms includes first and second link arms with opposite end portions and a middle portion. The first and second link arms are pivotally connected to each other at their middle portions by a middle pivot joint.

The first link arm of the first pair of link arms and the second link arm of the second pair of link arms are pivotally connected to each other at one of their end portions by a lower pivot joint. Likewise, the second link arm of the first pair of link arms and the first link arm of the second pair of link arms are pivotally connected to each other at the other of their end portions by an upper pivot joint.

One of the first and second portions of the actuator may be connected to one of the upper, lower, and middle pivot joints. The other of the first and second portions of the actuator may also be connected to another of the upper, lower, and middle pivot joints. Preferably, the one pivot joint and the another pivot joint are juxtaposed.

According to a further embodiment of the invention, the actuator is a fluid-powered actuator with the first actuator portion being a reciprocal shaft and the second actuator portion being a housing for receiving the reciprocal shaft. The housing includes a first inlet port for extending the shaft out of the housing and a second inlet port for retracting the shaft into the housing when air under pressure is applied to the first and second ports, respectively.

At least one control valve may be fluidly connected to the first and second ports for controlling extension and retraction of the shaft.

At least one bracket may be connected to at least one end of the lattice assembly for mounting the lattice assembly to at least one of the door and the structural member. The bracket may include shock absorbing means and door reversing means mounted thereto for instances where the door may strike an object during movement.

Other objects, advantages and novel features of the present invention will become apparent from the following detailed description of the invention when considered in conjunction with the accompanying drawings.

BRIEF DESCRIPTION OF THE DRAWINGS

The invention will now be described with reference to the drawings in which.

DETAILED DESCRIPTION OF THE PREFERRED EMBODIMENTS

Figure 1:
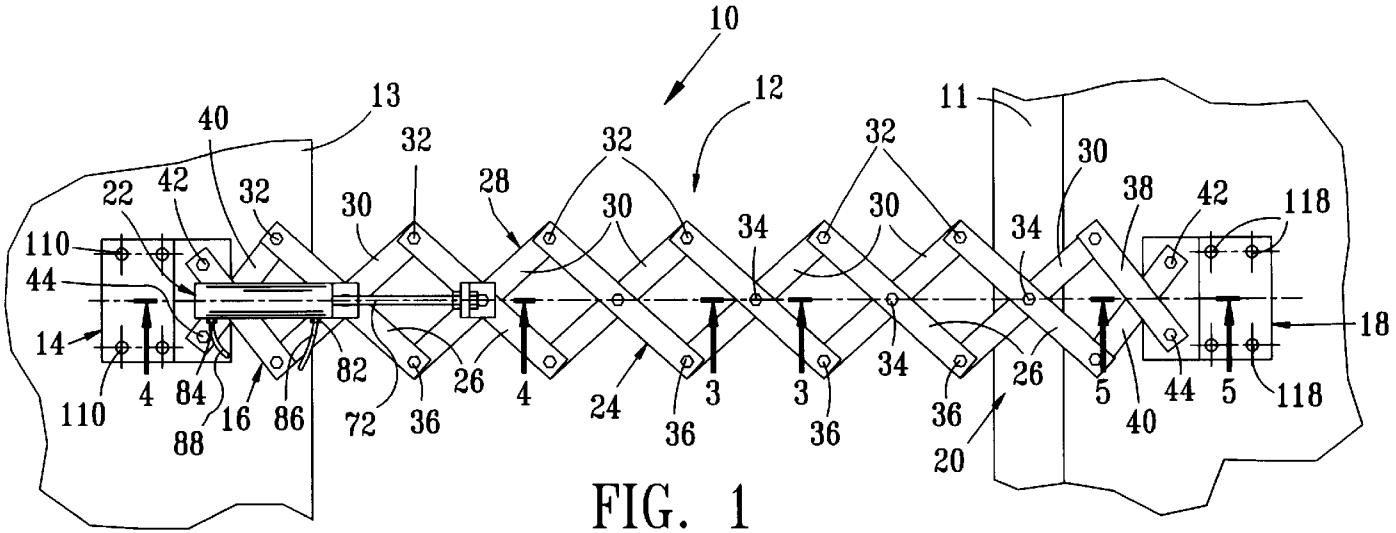
FIG. 1 is a side elevational view of a door operator according to the invention in an expanded state.
Figure 2:
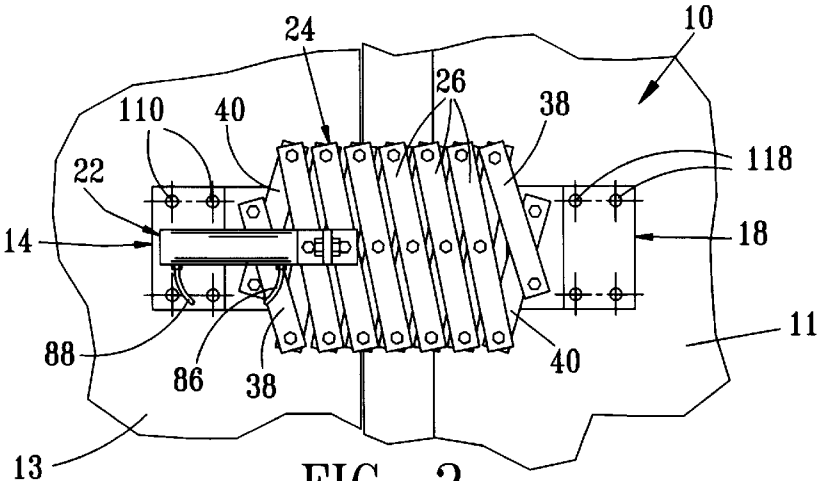
FIG. 2 is a side elevational view of the door operator of FIG. 1 in a retracted state.

Referring now to the drawings, and to FIGS. 1 and 2 in particular, a door operating device 10, for connection between a door 11 and a wall 13 or other surface, comprises a lattice assembly 12, a wall mounting bracket 14 connected to a first end 16 of the lattice assembly 12, a door mounting bracket 18 connected to a second end 20 of the lattice assembly, and an actuator 22 operably connected to the lattice assembly 12 for expanding and contracting the lattice assembly.

The lattice assembly 12 has a first link arm set 24 with a plurality of forward link arms 26 and a second link arm set 28 with a plurality of rearward link arms 30. The forward link arms 26 are preferably arranged substantially parallel to each other. Likewise, the rearward link arms are arranged substantially parallel to each other and nonparallel to the forward link arms 28. The link arms 26, 30 each include an upper pivot joint 32, a middle pivot joint 34, and a lower pivot joint 36. The upper pivot joint 32 pivotally connects a forward link arm 26 with a preceding rearward link arm 30. The middle pivot joint 34 pivotally connects the forward link arm 26 with a corresponding rearward link arm 30 adjacent the preceding rearward link arm. Finally, the lower pivot joint 36 pivotally connects the forward link arm with a proceeding rearward link arm 30 adjacent the corresponding link arm. Preferably, the forward and rearward link arms are of the same length. As used herein, the terms "forward," "rearward," "upper," and "lower" are indicative of relative, not absolute orientations or positions.

At the lattice first end 16, a forward bracket arm 38 has one end pivotally connected to a rearward link arm 30 at a lower pivot joint 36 and an opposing end pivotally connected to the wall mounting bracket 14 at an upper pivot joint 42. A rearward bracket arm 40 has one end pivotally connected to a forward link arm 26 at an upper pivot joint 32 and an opposing end pivotally connected to the wall mounting bracket 14 at a lower pivot joint 44.

Likewise, at the lattice second end 20, a forward bracket arm 38 has one end pivotally connected to a rearward link arm 30 at an upper pivot joint 32 and an opposing end pivotally connected to the door mounting bracket 18 at a lower pivot joint 44. A rearward bracket arm 40 has one end pivotally connected to a forward link arm 26 at a lower pivot joint 36 and an opposing end pivotally connected to the door mounting bracket 18 at an upper pivot joint 42. Preferably, the forward and rearward bracket arms at the first and second lattice ends are of the same size and are shorter than the forward and rearward link arms. The bracket arms are absent a middle pivot joint, such that the arms slide freely along each other as the lattice is expanded and contracted.

Figure 3:
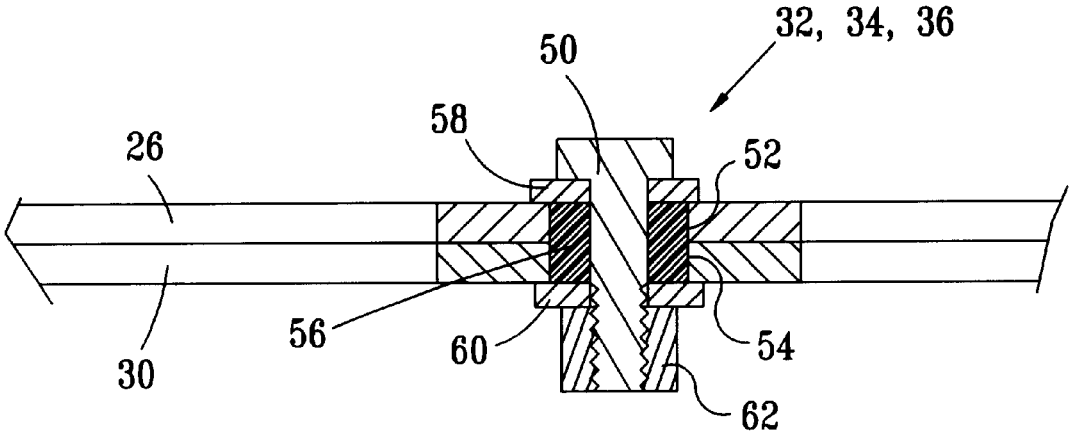
FIG. 3 is an enlarged cross sectional view of a pivot joint taken along line 3—3 of FIG. 1.

With additional reference to FIG. 3, each pivot joint 32, 34 and 36 includes a threaded bolt 50 that extends through a sleeve 56 that is positioned in aligned holes 52 and 54 in the forward and rearward link arms 26 and 30, respectively. A pair of washers 58, 60 are positioned at opposite ends of the sleeve 56 and a lock nut 62 is threaded onto the bolt for holding the pivot joint components together. Preferably, the length of the sleeve 56 is substantially equal to, or slightly greater than the combined thickness of the link arms 26 and 30, and is constructed of a durable and wear-resistant material, such as nylon, brass, etc. The sleeve 56 permits free rotation of the link arms 26 and 30 with respect to each other as the lattice is expanded and retracted.

Figure 4:
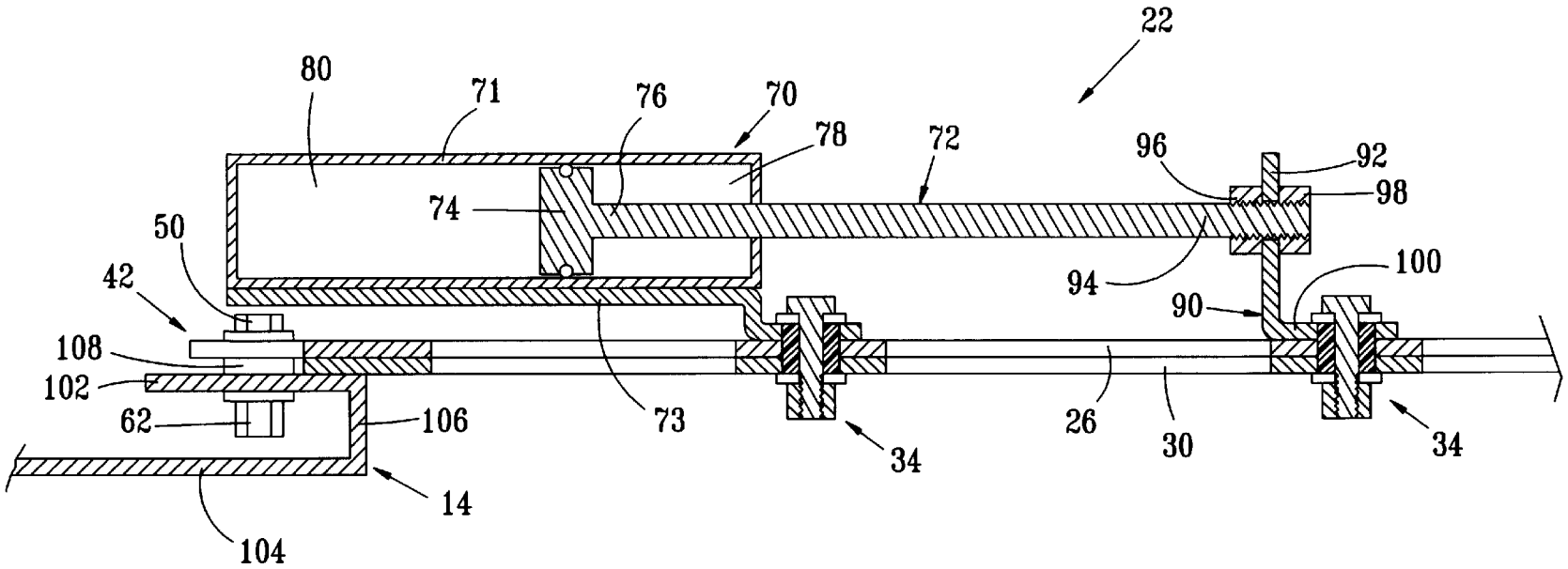
FIG. 4 is an enlarged cross sectional view of an actuator portion of the door operator taken along line 4—4 of FIG. 1.

With reference now to FIGS. 1 and 4, the actuator 22 has a base member 70 that comprises a cylindrical housing 71 and a base plate 73 fixedly attached to the housing. A shaft 72 reciprocates into and out of the housing 70. A plunger head 74 is mounted to an inner end portion 76 of the shaft and separates the housing 70 into a first or proximal chamber 78 and a second or distal chamber 80. A first inlet/exhaust port 82 is associated with the proximal chamber 78 and a second inlet/exhaust port 84 is associated with the distal chamber 80 for alternately supplying fluid to, and removing fluid from the chambers. Fluid is supplied and removed from the chambers through a pair of pressure hoses or lines 86 and 88 that are fluidly connected to an actuator control system 160, as described in greater detail below with respect to FIG. 7.

An L-shaped bracket 90 has a first leg 92 that is connected to an outer end portion 94 of the shaft 72. A pair of nuts 96, 98 are threaded on the outer end portion 94 of the shaft and are located on either side of the leg 92. A second leg 100 of the bracket 90 is preferably connected to one of the middle pivot joints 34. The base plate 73 is also preferably connected to one of the middle pivot joints 34 adjacent the pivot joint 34 associated with the L-shaped bracket 90. With the housing and reciprocal shaft both connected to adjacent or juxtaposed pivot joints, the actuator stroke length can be made much smaller than if one of the housing and shaft were to be connected to the wall or door. As shown in FIGS. 1 and 2, the position of the actuator 22 with respect to the bracket 14 changes as the lattice assembly moves between the extended and retracted positions. Although the middle pivot joints are the preferred connection locations, it is to be understood that other pivot joints may be suitable mounting locations for the actuator housing and shaft. For example, the housing may be connected to an upper, middle or lower pivot joint, while the outer end portion of the shaft is connected to another upper, middle, or lower pivot joint, or any combination thereof.

The wall mounting bracket 14 is generally U-shaped in configuration and includes a relatively short leg 102 connected to a relatively long leg 104 by a bight portion 106. Preferably, the legs 102 and 104 extend substantially parallel to each other, but may be modified depending on the shape of the surface to which the bracket 14 is mounted. The leg 102 includes laterally spaced apertures (not shown) for mounting the forward and rearward bracket arms 38, 40 at the lattice first end 16 to the bracket 14 through the upper and lower pivot joints 42, 44. Preferably, the upper and lower pivot joints are similar in construction to the pivot joints 32, 34, 36, with the exception that an annular spacer member 108 may be positioned between the forward link arm 26 and the short leg 102 for lending support to the arm 26 when the lock nut 62 is tightened on the bolt 50. A plurality of openings 110 (FIGS. 1 and 2) are formed in the long leg 104. The openings 110 are sized to receive suitable fasteners for mounting the bracket 14 to a wall 13 or other surface.

Figure 5:
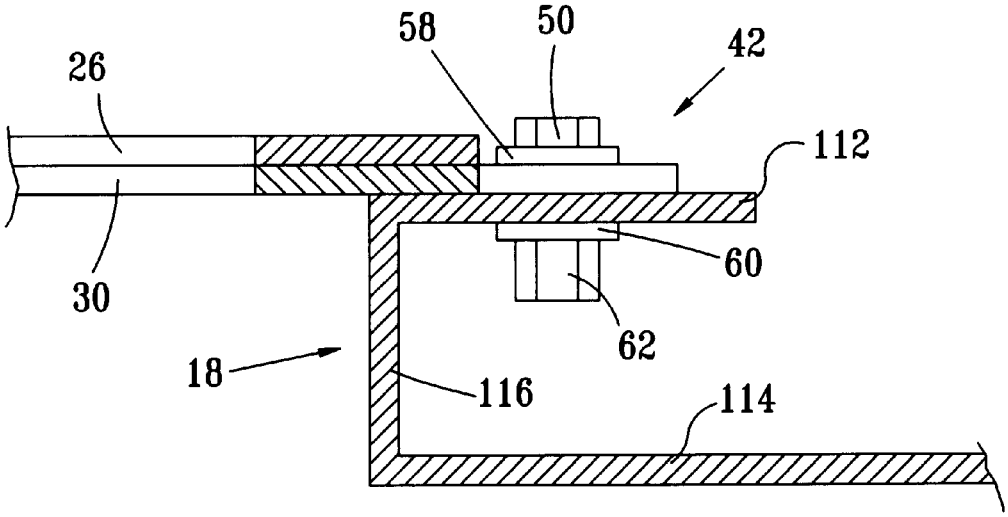
FIG. 5 is an enlarged cross sectional view of a door bracket taken along line 5—5 of FIG. 1.

With reference now to FIG. 5, the door mounting bracket 18 is similar in construction to the wall mounting bracket and includes a relatively short leg 112 connected to a relatively long leg 114 by a bight portion 116. The bight portion 116 is preferably longer than the bight portion 106 when the door 11 is spaced outwardly from the wall 13. Depending on the location of the door with respect to the wall or other surface, the size of the bight portions or shape of the brackets may change. As with the leg 102 of bracket 14, the leg 112 includes laterally spaced apertures (not shown) for mounting the forward and rearward bracket arms 38, 40 at the lattice second end 20 to the bracket 18 through the upper and lower pivot joints 42, 44. As with the bracket 14, the bracket 18 includes a plurality of openings 118 (FIGS. 1 and 2) that are formed in the long leg 114. The openings 118 are sized to receive suitable fasteners for mounting the bracket 18 to a door 11.

In use, with reference again to FIGS. 1, 2 and 4, as fluid under pressure is supplied to the proximal chamber 78, the shaft 72 is forced inward into the housing 70 and fluid is exhausted from the distal chamber 80 to retract the lattice assembly 12 and close the door, as shown in FIG. 2. Likewise, when fluid under pressure is supplied to the distal chamber 80, the shaft 72 is forced outward of the housing 70 and fluid is exhausted from the proximal chamber 78 to expand the lattice assembly 12 and open the door, as shown in FIG. 1. Although pressurized air is the preferred fluid for operating the actuator, vacuum, hydraulic fluid, etc., can additionally or alternatively be used.

The amount of door movement can be adjusted by adding or removing forward and rearward link arm pairs, and/or adjusting the amount of actuator stroke. The arrangement as shown in FIG. 1 has seven forward and rearward link arm pairs and is therefore capable of moving a sliding door approximately seven times the distance of the actuator stroke length. Thus, for a stroke length of 6 inches, the door will move a distance of approximately 42 inches. The speed at which the door moves is approximately the same speed as the actuator shaft during movement into or out of the housing. Thus, for the above example, if the shaft moves six inches in 0.5 seconds, the door will move 42 inches in the same amount of time if intervening controls are not used.

Figure 6:
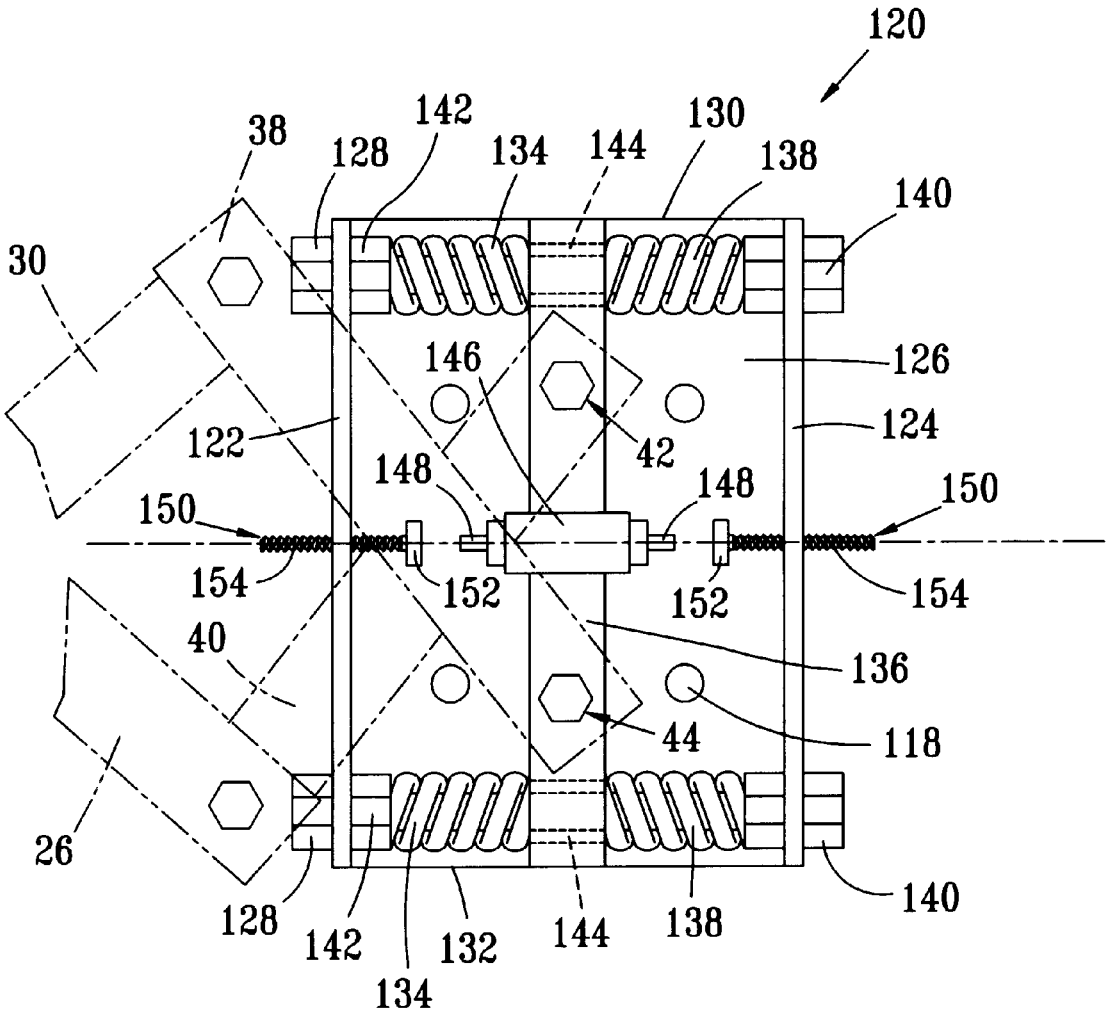
FIG. 6 is an enlarged plan view of a door bracket according to a further embodiment of the invention.

With reference now to FIG. 6, a door mounting bracket 120 according to a further embodiment of the invention is illustrated, wherein like parts in the previous embodiment are represented by like numerals. The door mounting bracket 120 is generally U-shaped in configuration and includes a first leg 122 connected to a second leg 124 by a bight portion 126. Preferably, the legs 122 and 124 are of the same height and extend substantially parallel to each other. A pair of bolts, shafts, or studs 128 is mounted to the bracket 120 adjacent opposite side portions 130, 132 of the bracket. Each bolt 128 extends through the first leg 122, a first compression spring 134, an armature 136, a second compression spring 138, and finally the second leg 124. A nut 140 is secured to the end of each bolt adjacent the second leg 124 for securing each bolt, the springs, and armature to the bracket 120. An adjustable spring compression nut 142 is threaded onto each bolt, preferably adjacent the first leg 122 for adjusting the amount of compressive forces acting on the armature.

The armature 136 is preferably tubular in construction and rectangular in cross section. Bushings 144 (shown in hidden line) are mounted in opposite end portions of the armature 136 and slide on the bolts 128 to provide low friction operation. Each bushing is preferably constructed of nylon or other wear-resistant material. The springs 134, 138 on either side of the armature provide protection when the door encounters an obstruction during opening or closing movement.

A four-way spool valve 146 is mounted on the armature 136 and includes a pair of valve stems 148 that extend in opposite directions toward the legs 122 and 124. A valve trigger 150 is mounted on each leg 122 and 124. Each valve trigger 150 includes a head 152 that is positioned proximal to, and in alignment with one of the valve stems 148 and a threaded shaft 154 that extends from the head 152 through a threaded opening (not shown) in one of the legs 122, 124. The four-way spool valve 146 is to be used in conjunction with the actuator control system described below, and functions to reverse the action of the actuator when one of the valve stems presses against its associated valve trigger to thereby reverse the direction of the door. The proximity of the head 152 to its associated valve stem 148 can be independently adjusted to suit sensitivity requirements by simply rotating the valve trigger 150.

Figure 7:
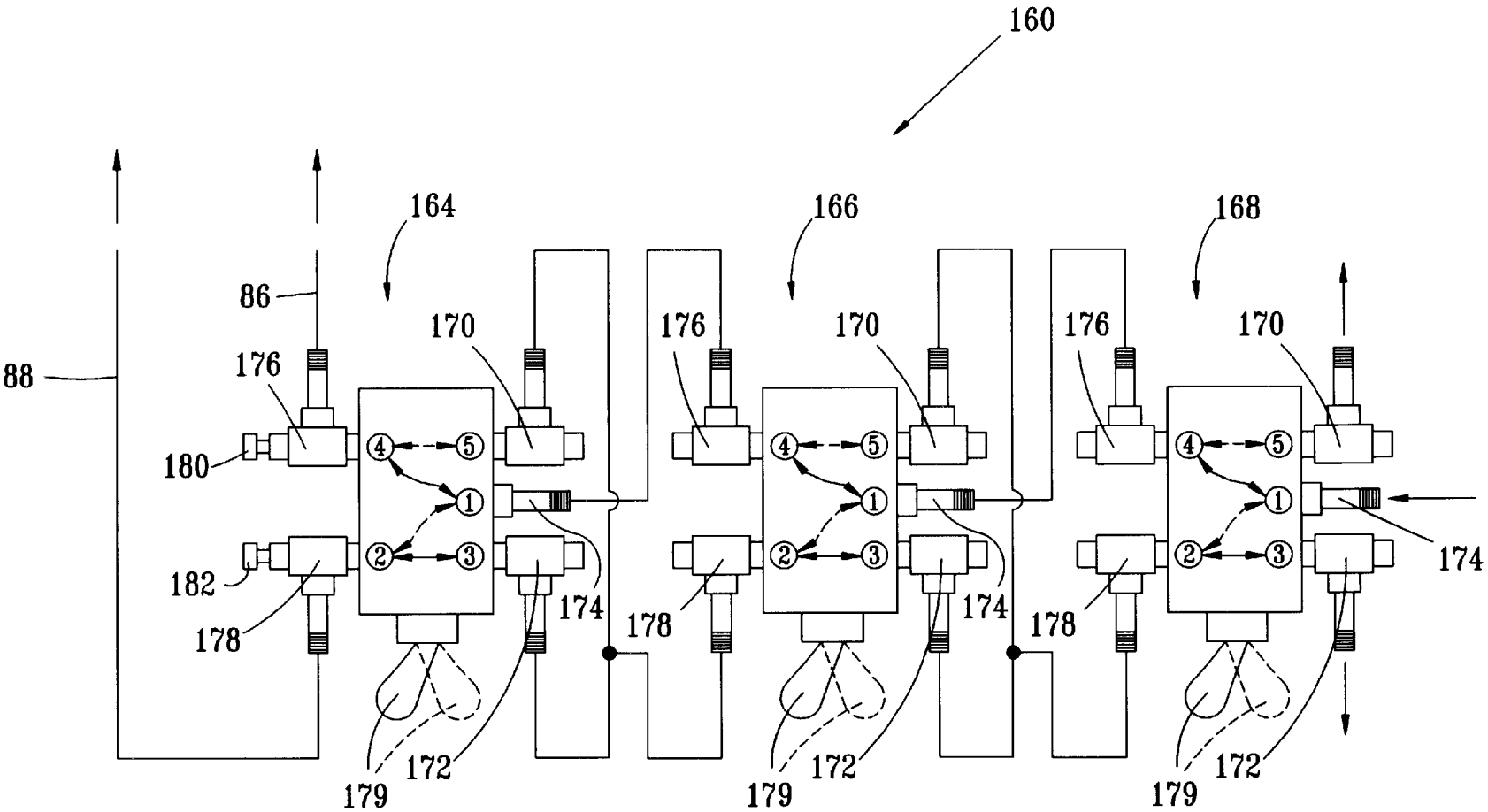
FIG. 7 is a schematic diagram of an actuator control system for use with the door operator of FIG. 1.

Turning now to FIG. 7, a system 160 for controlling operation of the actuator 22 includes the first pressure line 88 for extending the shaft 72 from the cylinder 71 and the second pressure line 86 for retracting the shaft 72 back into the cylinder 71 to open and close the door, respectively. The pressure lines 88 and 86 are connected to a four-way air toggle switch 164 in a Hoffman enclosure, which may in turn be connected in series to additional toggle switches 166, 168, etc., and finally to a source of compressed air. One of the toggle switches may be replaced with the four-way spool valve 146 described above, which functions in a similar manner as the toggle switches. Alternatively, the four-way spool valve may be an additional switch connected in series with the switches 164, 166 and 168. Each toggle switch 164, 166, 168 includes a pair of exhaust ports 170 and 172 (labeled 5 and 3, respectively), an air inlet port 174 (labeled 1), a pair of combination inlet/outlet ports 176, 178 (labeled 4 and 2, respectively), and a manual control switch 179. Port 176 of the toggle switch 164 is connected to line 86 and includes a needle valve assembly 180 for regulating air flow through the line 86. Adjustment of the needle valve assembly 180 controls the door closure speed. Likewise, port 178 of the toggle switch 164 is connected to line 88 and includes a needle valve assembly 182 for regulating air flow through the line 88. Adjustment of the needle valve assembly 182 controls the door opening speed. The combination port 176 of toggle switch 166 is connected in series to the inlet port 174 of the toggle switch 164. The combination port 178 of toggle switch 166 is connected to exhaust ports 170 and 172 of the toggle switch 164. The toggle switch 168 is connected in series to the toggle switch 166 in a similar manner.

In operation, when the manual control switch 179 of toggle switch 164, for example, is in the position as shown in solid line, air passages are open between ports 1, 4 and 3, 2 to apply pressure to line 86 and exhaust air from line 88 to thereby close the door 11. When the manual control switch 179 of the toggle switch 164 is reversed, as represented by dashed line, air passages between ports 1, 2 and 5, 4 are open to apply pressure to line 88 and exhaust air from line 86 to thereby open the door. The toggle switches 166 and 168, as well as the spool valve 146, operate in a similar manner, although the spool valve is controlled automatically by the valve stems 148 and valve triggers 150.

Although intended primarily for use with horizontal sliding doors, the present invention can also be used for opening and closing overhead doors or for moving one object with respect to another object with a relatively short actuator stroke length. Moreover, although an air-operated actuator is preferred, other actuators, such as solenoids, electric motors equipped with power screws, etc., may alternatively be used to accomplish the expansion and contraction of the lattice assembly.

While particular embodiments of the invention have been shown, it will be understood that the invention is not limited thereto since modifications may be made by those skilled in the art, particularly in light of the foregoing teachings.

The embodiments for which an exclusive property or privilege is claimed are defined as follows:

1. A door operator system, comprising:

an expandable and retractable lattice assembly adapted for connection between a door and a stationary structure, said lattice assembly having a first pair of link arms pivotally connected together at a first middle pivot joint and at least a second pair of link arms pivotally connected together at a second middle pivot joint, the first pair of link arms being pivotally connected to the second pair of link arms at upper and lower pivot joints, such that the distance between a retracted position and an expanded position of said lattice assembly is relatively long; and an actuator having a first portion that is reciprocal with respect to a second portion between a first position and a second position, the distance between the first and second positions being relatively short, said first portion being operably connected to said lattice assembly at a first location and said second portion being connected to said lattice assembly at a second location spaced from the first location for expanding and contracting said lattice assembly;

wherein first and second locations move during expanding and contracting of said lattice assembly;

wherein movement of said first portion of said actuator between said first and second positions over said relatively short distance causes said lattice assembly to move between said retracted and expanded positions over said relatively long distance, thereby causing movement of the door with respect to the stationary structure over said relatively long distance when said lattice assembly is connected between the door and the stationary structure.

2. A door operator system according to claim 1 wherein each pair of link arms includes first and second link arms with opposite end portions and a middle portion, said first and second link arms of each of said first and second pairs of link arms being pivotally connected to each other at said middle portions by said first and second middle pivot joints respectively.

3. A door operator system according to claim 2 wherein the first link arm of the first pair of link arms and the second link arm of the second pair of link arms are pivotally connected to each other at one of their end portions by said lower pivot joint.

4. A door operator system according to claim 3 wherein the second link arm of the first pair of link arms and the first link arm of the second pair of link arms are pivotally connected to each other at the other of their end portions by said upper pivot joint.

5. A door operating system according to claim 4 wherein one of said first and second portions of said actuator is connected to one of said upper, lower, and middle pivot joints.

6. A door operating system according to claim 5 wherein the other of said first and second portions of said actuator is connected to another of said upper, lower, and middle pivot joints.

7. A door operating system according to claim 6 wherein said one pivot joint and said another pivot joint are juxtaposed.

8. A door operating system according to claim 2 wherein one of said first and second portions of said actuator is connected to one of said middle pivot joints.

9. A door operating system according to claim 8 wherein the other of said first and second portions of said actuator is connected to another of said middle pivot joints.

10. A door operating system according to claim 9 wherein said one middle pivot joint and said another middle pivot joint are juxtaposed.

11. A door operating system according to claim 9 wherein said actuator is fluid powered, and further wherein said first portion is a reciprocal shaft and said second portion is a housing for receiving said reciprocal shaft, said housing including a first inlet port for extending said shaft out of said housing and a second inlet port for retracting said shaft into said housing when air under pressure is applied to said first and second ports, respectively.

12. A door operating system according to claim 11 and further comprising at least one control valve fluidly connected to said first and second ports for controlling extension and retraction of said shaft.

13. A door operating system according to claim 12 wherein said control valve is manually operable.

14. A door operating system according to claim 12 and further comprising at least one bracket connected to at least one end of said lattice assembly for mounting said lattice assembly to at least one of the door and the structural member.

15. A door operating system according to claim 14 and further comprising shock absorbing means mounted on the at least one bracket.

16. A door operating system according to claim 12 wherein said shock absorbing means comprises an armature slidably mounted on the bracket and at least one spring mounted between one side of said armature and the bracket for biasing the armature toward a rest position, an end portion of said lattice assembly being connected to said armature, wherein forces generated by impeded movement of the door in at least one direction and transmitted to the armature through the lattice assembly can be absorbed by the spring.

17. A door operating mechanism according to claim 16 and further comprising means operably connected to said bracket for reversing movement of said actuator first member when said spring is compressed a predetermined amount.

18. A door operating mechanism according to claim 17 wherein said reversing means comprises:

a reversing valve mounted on said armature for movement therewith, said reversing valve having at least one valve stem; and a valve trigger mounted on said bracket proximal said valve stem;

wherein movement of said armature with respect to said bracket in at least one direction beyond a predetermined distance causes said valve stem to contact said valve trigger thereby reversing movement of said actuator first member.

19. A door operating system according to claim 1 and further comprising at least one bracket connected to at least one end of said lattice assembly for mounting said lattice assembly to at least one of the door and the structural member.

20. A door operating system according to claim 19 and further comprising shock absorbing means mounted on the at least one bracket.

21. A door operating system according to claim 20 wherein said shock absorbing means comprises an armature slidably mounted on the bracket and at least one spring mounted between one side of said armature and the bracket for biasing the armature toward a rest position, an end portion of said lattice assembly being connected to said armature, wherein forces generated by impeded movement of the door in at least one direction and transmitted to the armature through the lattice assembly can be absorbed by the spring.

22. A door operating mechanism according to claim 21 and further comprising means operably connected to said bracket for reversing movement of said actuator first member when said spring is compressed a predetermined amount.

23. A door operating mechanism according to claim 21 and further comprising a second spring mounted between an opposite side of said armature and said bracket for biasing the armature to the rest position, wherein forces generated by impeded movement of the door in opposite directions and transmitted to the armature through the lattice assembly can be absorbed by the springs.

24. A door operating mechanism according to claim 23 and further comprising means operably connected to said bracket for reversing movement of said actuator first member when one of said springs is compressed a predetermined amount.

* * * * *